US005832837A

United States Patent [19]

Edwards

[11] Patent Number: 5,832,837

[45] Date of Patent: Nov. 10, 1998

[54] METHOD OF ASSEMBLING A MODEL RAILROAD TRUCK

[75] Inventor: Lawrence D. Edwards, Eagle Point, Oreg.

[73] Assignee: Kadee Quality Products Co., White City, Oreg.

[21] Appl. No.: 46,368

[22] Filed: Mar. 23, 1998

Related U.S. Application Data

[62] Division of Ser. No. 794,525, Feb. 3, 1997, Pat. No. 5,768, 999.

[51] Int. Cl.[6] ..... B61F 5/00

[52] U.S. Cl. ..... 105/157.2; 105/197.005

[58] Field of Search ..... 105/157.2, 197.05, 105/197.1, 157.1

[56] References Cited

U.S. PATENT DOCUMENTS

| | | | |
|---|---|---|---|
| 1,916,080 | 6/1933 | Somervell | 105/197.05 |
| 2,021,285 | 11/1935 | Busch | 105/197.05 |
| 2,084,028 | 6/1937 | Hedgcock | 105/197.05 |
| 2,915,988 | 12/1959 | Varney | 105/197.05 |
| 3,064,588 | 11/1962 | Zion | 105/157.2 |
| 3,120,080 | 2/1964 | Hahn | 105/157.2 |
| 3,397,483 | 8/1968 | Lingard | 105/157.2 |
| 5,398,619 | 3/1995 | Buccos | 105/157.2 |

*Primary Examiner*—Mark Tuan Le
*Attorney, Agent, or Firm*—Robert D. Varitz, P.C.

[57] ABSTRACT

A method of assembling a model railroad truck includes placing a truck spring on a spring retainer which is carried on either of a truck bolster or a truck side frame, resting the free end of the truck spring on the other element of the truck, pushing the end of the truck bolster into the upper portion of the bolster receiver, such that the end of the truck bolster travels along truck radii of the bolster receiver, compressing the truck spring while simultaneously pushing the end of the truck bolster through the bolster receiver, and decompressing the truck springs to allow the bolster to be retained in the side frame.

2 Claims, 3 Drawing Sheets

METHOD OF ASSEMBLING A MODEL RAILROAD TRUCK

RELATED APPLICATION

This is a division of application Ser. No. 08/794,525, filed Feb. 3, 1997, now U.S. Pat. No. 5,768,999, granted Jun. 23, 1998.

FIELD OF THE INVENTION

This invention relates to trucks for use on model railroad rolling stock, and specifically to a truck assembly which lends itself to automated assembly.

BACKGROUND OF THE INVENTION

Trucks that are used on model railroad rolling stock are scaled-down versions of prototypical railroad trucks. Although the framework for some trucks are formed as a one-piece structure, most trucks used by serious model railroaders include separate truck bolsters and side frames, wherein the bolsters are held in the side frames by means of springs, which allow a side frame to move relative to the bolster and to the other side frame. Wheel sets for each truck, including an axle having a wheel at each end thereof, are contained within journal boxes, which are located at the ends of the side frames. The flexible nature of the multi-piece truck allows the wheel sets to follow irregularities in the track, thereby maintaining the truck, and in turn, the rolling stock, on the track.

Known flexible trucks are quite difficult to assemble because the springs, which hold the truck elements together, are essentially free-floating, i.e., they are not secured to either the bolster or the side frame, and are usually captured to prevent lateral movement of the springs by protrusions which extend from the bolster and side frames. The springs used in both prototypical and model railroad trucks are coil springs, which extend between the end of a bolster and a truck side frame. In conventional model railroad trucks, the springs are not secured to either the truck side frame or the bolster in any way, and remain fixed because of the protrusions and their own tension. Such springs are typically less than 0.16 cm in diameter and approximately 0.3 cm in non-compressed length. They are most difficult to handle. Although a number of pics have been developed to assist a model railroader with the insertion of springs into a truck assembly, the assembly of a conventional truck still requires that each individual spring be placed between the bolster and side frame. Generally, four springs are provided, two associated with each end of the bolster. Such assembly does not lend itself to any type of automation, and further, requires delicate manual assembly of the truck assembly, a task which produces stress in the hands and eyes of the assembly worker.

BRIEF SUMMARY OF THE INVENTION

The model railroad truck structure of the invention includes a truck bolster which has a side-frame keeper on each end thereof for maintaining a side frame in position on the bolster. An elongate truck side frame is carried on each end of the truck bolster, which is received within a bolster receiver therein. A spring retainer is provided for receiving a spring thereon and for maintaining the spring in position between the truck bolster and the side frame. The spring retainer may be located on the bolster or on the side frame.

The method of the invention includes placing truck springs on a spring retainer, which is carried on either of a truck bolster or a truck side frame, resting the free end of the truck spring on the other element of the truck, pushing the end of the truck bolster into the upper portion of the bolster receiver, such that the end of the truck bolster travels along a truck radius of the bolster receiver, compressing the truck spring while simultaneously pushing the end of the truck bolster through the bolster receiver, and decompressing the truck springs to allow the bolster to be retained in the side frame.

It is an object of the invention to provide a model railroad truck structure which lends itself to automatic assembly of the truck structure.

Another object of the invention is to provide a spring retainer which will hold a coil spring thereon during the assembly process.

A further object of the invention is to provide a mechanism for securing springs to a bolster such that the securing mechanism will retain the springs thereon during assembly of the bolster and a side frame.

These and other objects and advantages of the invention will become more fully apparent as the description which follows is read in conjunction with the drawings.

DETAILED DESCRIPTION OF THE PREFERRED EMBODIMENT

Figure 1:
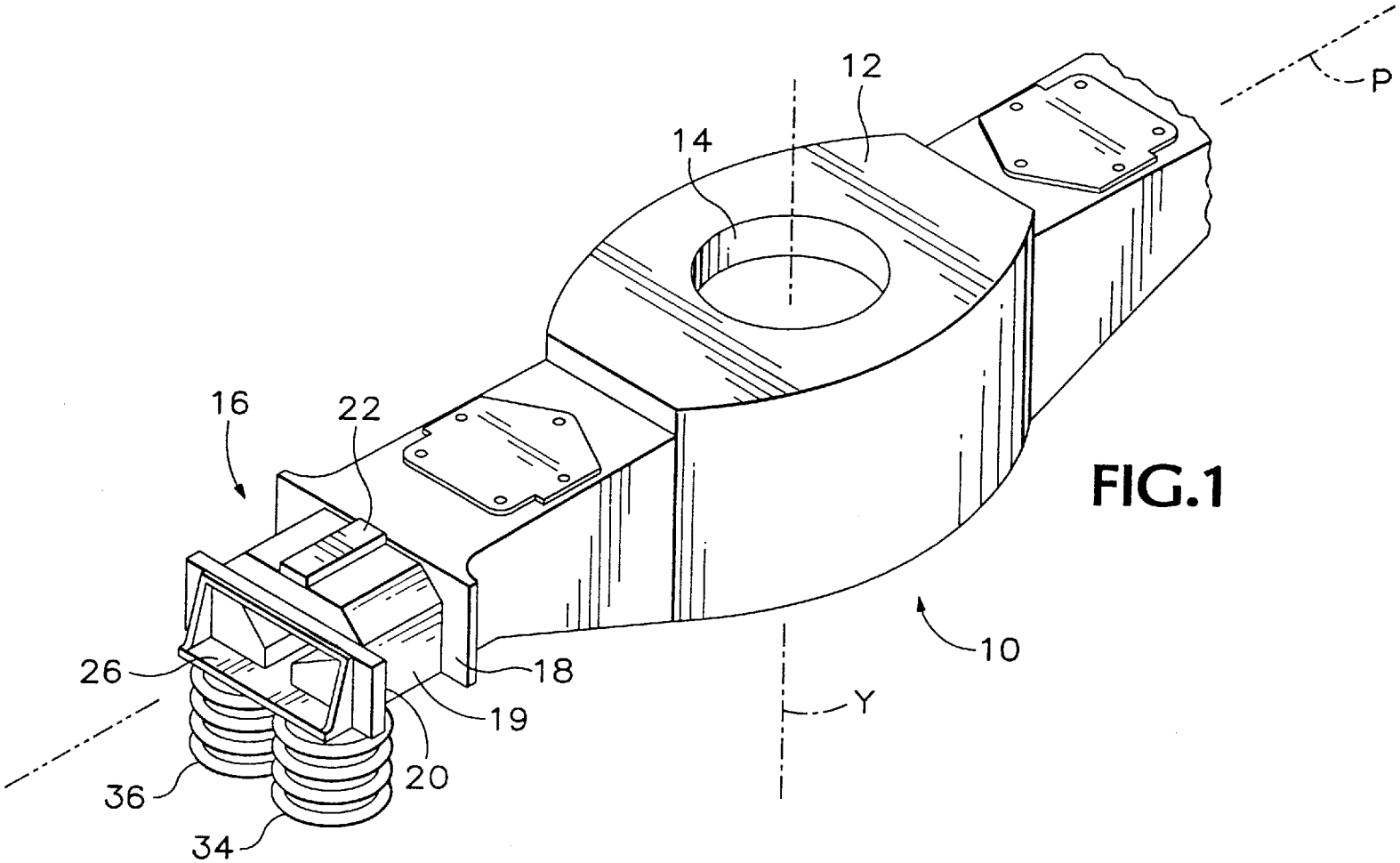
FIG. 1 is a perspective view of a portion of a bolster of the invention.

Referring initially to FIG. 1, a truck bolster of the invention is depicted generally at 10. Bolster 10 is an elongate structure and includes an enlarged region, referred to herein as a bolster mount 12, having a bore 14 extended vertically therethrough. Bore 14 receives a fastener which secures bolster 10 to a unit of rolling stock (not shown). A side-frame keeper 16 is located at each end of bolster 10. Bolster 10 has a yaw axis, depicted by dash-dot line at "Y", and a pitch axis, depicted by dash-double-dot line "P".

Figure 4:
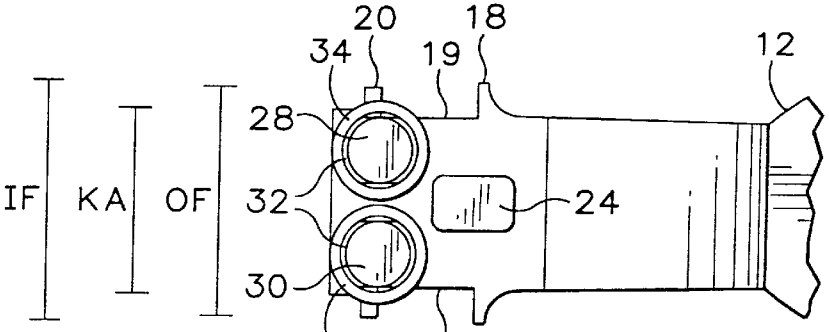
FIG. 4 is a bottom plan view of the bolster of the invention.
Figure 3:
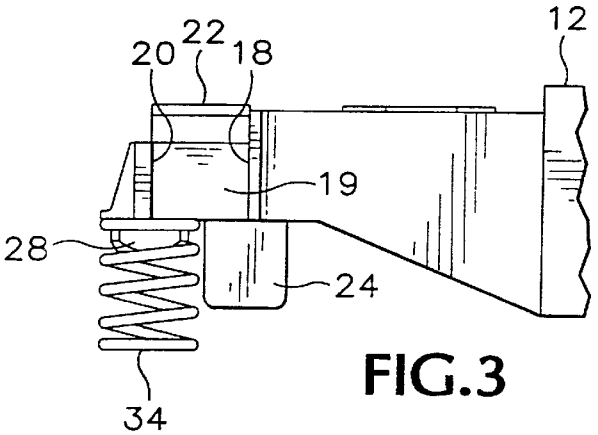
FIG. 3 is a partial front elevation of the bolster of the invention.

Referring now to FIGS. 1, 3, and 4, side-frame keeper 16 includes an inner flange 18, a vertically oriented fore-keeper abutment 19, an outer flange 20, a vertically oriented aft-keeper abutment 21, an upper spacer 22, and a lower spacer 24. Keeper abutments 19, 21 extend laterally between inner flange 18 and outer flange 20. It may be seen that the end 26 of side-frame keeper 16 is somewhat hollowed out and includes some structural elements therein. Such structural elements are formed to provide a prototypical appearance to the end of the side-frame keeper. Referring to FIG. 4, outer flange 20 has a longitudinal dimension OF, inner flange 18 has a longitudinal dimension IF, and a longitudinal dimension KA extends between keeper abutments 19 and 21. As used herein, "longitudinal dimension" means a dimension that extends along the fore-to-aft extend of the truck.

In the preferred embodiment, a pair of spring retainers 28, 30 are provided adjacent the end of bolster 10. Spring retainers 28, 30 protrude downward from side-frame keeper 16. Each spring retainer may be seen to have a cylindrical cross section, and to include a chamfered region 32 adjacent to the free end thereof. Spring retainers 28, 30 have springs 34, 36, respectively, received thereon. Also in the preferred embodiment, spring retainers 28, 30 have an outside diameter of 0 .175 cm., and a length of 0.8 cm. Chamfered region 32 has an angle of 30° relative to the side of the spring retainer and the diameter of the spring retainer at the end of the chamfered region is 0.14 cm. The inner diameter of the coil springs is 0.01 cm less than the outside diameter of the spring retainer. This construction provides a clearance fittable, friction fit between the spring retainer and the coil spring. The springs are generally formed from spring steel, stainless steel or phosphor-bronze wire having a diameter of from 0.0051 cm to 0.0457 cm (0.002 in to 0.018 in).

Figure 2:
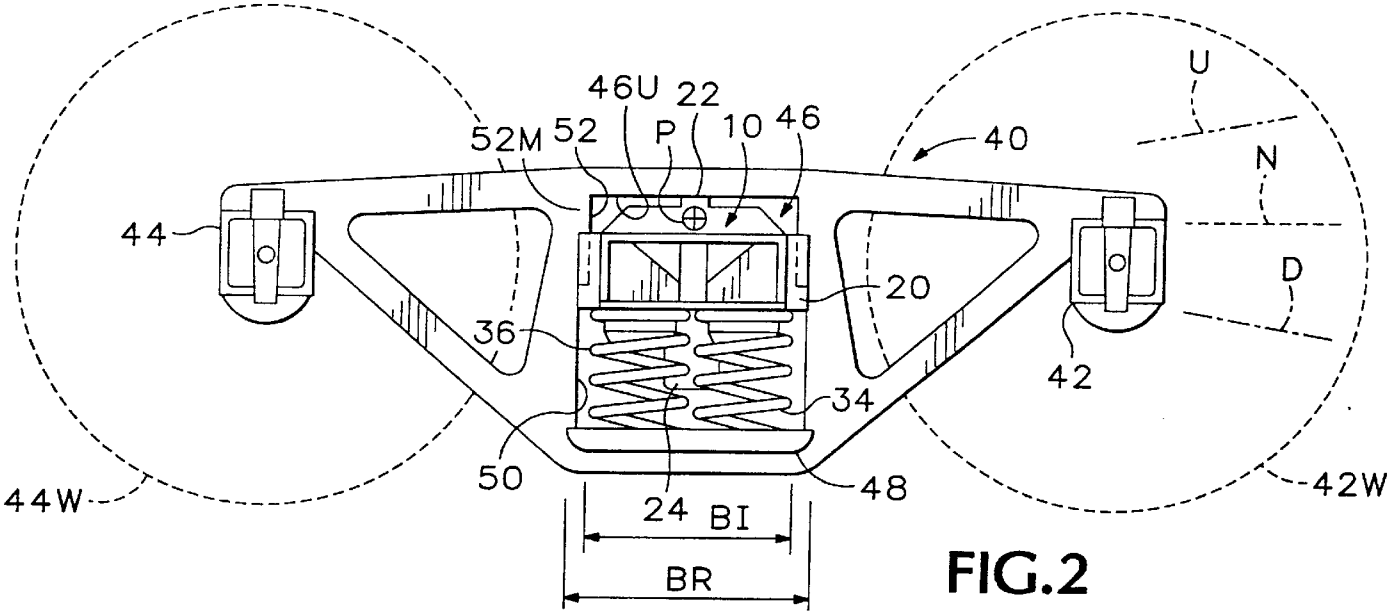
FIG. 2 is a side elevation of a model railroad truck constructed according to the invention.

Referring now to FIG. 2, an assembled truck is depicted generally at 38. Truck 38 includes a pair of elongate truck side frames, one of which is depicted generally at 40. Side frames 40 include journal boxes 42, 44 which rotatably receive wheel sets 42W, 44W (shown in dashed lines) therein. Each wheel set includes an axle having a wheel located adjacent each end thereof. Side frame 40 includes a bolster receiver 46 located intermediate the journal boxes. Bolster receiver 46 includes a spring pan 48, a bolster receiver slot 50 and a bolster radius slot 52. It may be seen that bolster receiver slot 50 has a longitudinal dimension BR, while bolster radius slot has a longitudinal dimension BI. Dimension BR is slightly larger than dimension BI. As previously noted, outer flange 20 has a longitudinal dimension OF, while inner flange 18 has a dimension IF, where dimension IF is larger than dimension OF. Dimension IF>Dimension BR>Dimension OF>Dimension BI>Dimension KA. This construction allows outer flange 20 to slip through bolster receiver slot 50 while inner flange 18 is too wide to pass through bolster receiver slot. Bolster radius slot 52, having dimension BI, is narrower than outer flange 20, and, will cause bolster 10 to be retained within bolster receiver 46 when outer flange 20 rides up over and abuts the outer margin 52M of bolster radius slot 52.

With bolster 10 received in bolster receiver 46, and with springs 34, 36 fully extended, upper spacer 22 abuts the upper margin 46U of bolster receiver 46, while lower spacer 24 serves as a stop during compression of springs 34, 36 to insure that bolster 10 does not ride down so far as to allow outer flange 20 to fully extend below bolster radius slot 52 into bolster receiver slot 50. Spacers 22 and 24 will prevent removal of bolster 10 from side frame 40 so long as bolster 10 and side frame 40 are in orthogonal relationship to one another.

Figure 5:
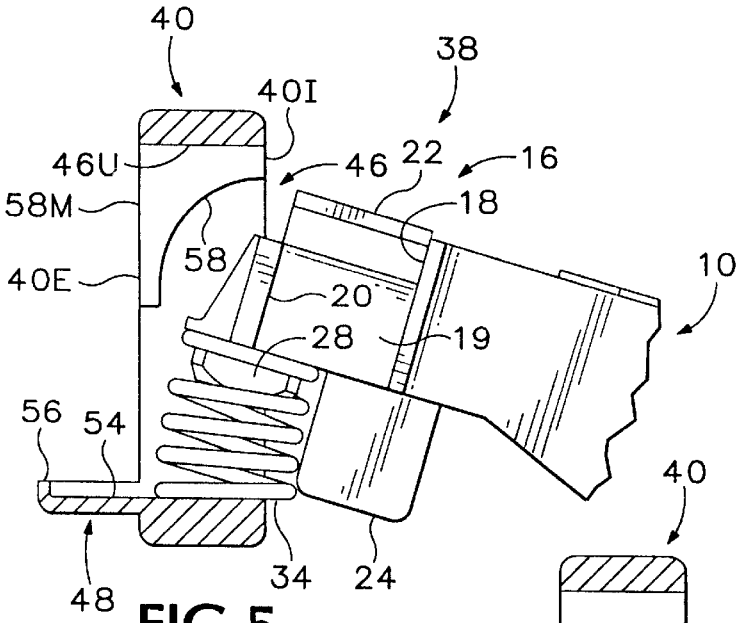
FIGS. 5–8 are sequential views of practicing the method of the invention.

Referring momentarily to FIG. 5, it may be seen that spring pan 48 includes a flat portion, or platform, 54, and a lip 56, which lip extends along an outer side of pan 48 on the exterior side 40E of side frame 40. A bolster radius, or guide, 58 may be seen, the outer margin of which, 58M, forms a side of bolster radius slot 52. As previously noted, at least one spring retainer is associated with each end of bolster 10. The spring retainer may be formed on the bolster, or it may be formed on the side frame, e.g., on spring pan 48.

Referring now FIGS. 5–8, the method of the invention will be described. Initially, in the preferred embodiment, springs 34, 36 are press fit and frictionally retainable on spring retainers 28, 30, respectively. Such assembly may be easily automated by placing bolster 10 into an appropriate jig, holding the bolster in the jig, and press fitting the springs onto the spring retainers. The springs are generally formed on a spring coiling machine, then placed onto the spring retainers by an automatic spring-sorting and assembling machine.

Once the springs have been assembled onto the truck bolster, the end of bolster 10 is inserted into bolster receiver 46 from the interior side 40I of side frame 40, with the free end of the springs resting on platform 54. Bolster 10 has a downward angle relative to the side frame at this point in the assembly process.

Figure 6:
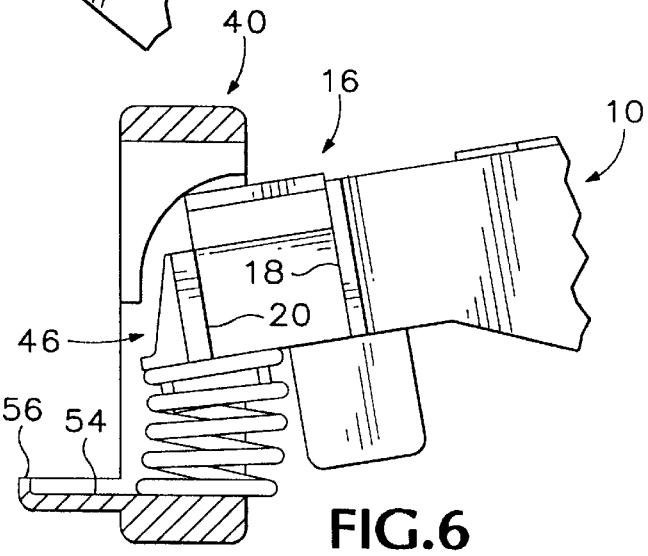

Referring to FIG. 6, bolster 10 is brought into contact with bolster radius 58 and the bolster is lifted upward relative to side frame 40, while the springs are maintained in a partially compressed condition, against platform 54.

Figure 7:
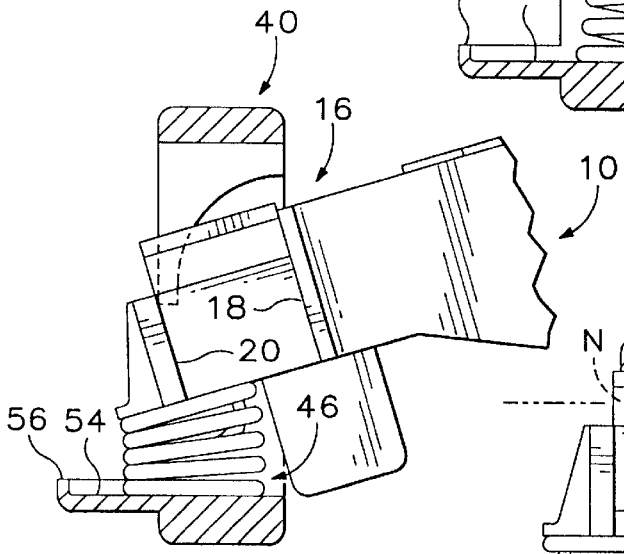

Referring to FIG. 7, the springs are further compressed, such that outer flange 20 extends through bolster receiver slot 50. Once the outer flange has cleared the exterior side 40E of the side frame, bolster 10 is aligned perpendicular to side frame 40, and is allowed to rise, in turn allowing springs 34, 36 to partially decompressed, to the position shown in FIG. 8, wherein the side frame is secured to the bolster. Each side frame may rock about bolster pitch axis P when in place on a unit of rolling stock. Bolster 10, in such condition, is secured to the rolling stock, and while the bolster may have a very limited movement about its pitch axis, it is generally confined to movement about its yaw axis Y. During assembly, bolster 10 may be moved about both its pitch and yaw axis during insertion into each side frame. When fully assembled, and the springs are in their maximum non-compressed condition, bolster 10 is orthogonal to each side frame 40.

Figure 8:
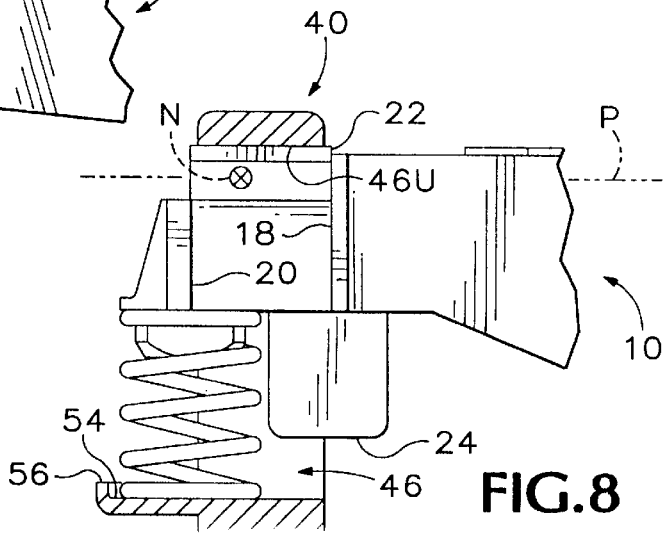

As may be seen in FIG. 8, the distance between lower spacer 24 and platform 54 is less than that between the upper margin 46U of bolster receiver 46 and the lower edge of bolster radius slot 52, preventing bolster 10 from being withdrawn from bolster receiver 46, so long as the bolster and the side frame remain substantially perpendicular. Disassembly may be accomplished by reversing the steps described in conjunction with FIGS. 5–8.

The arrangement of upper spacer 22 against the upper surface of bolster receiver 46 allows for a limited rocking motion of bolster 10 within bolster receiver 46, thereby allowing the side frames, and the wheel sets carried therein, to conform to any irregularities in the track surface. Fore and aft-abutment surfaces 19, 21 are sized such that KA<BI<BR, which provides a rocking clearance of the bolster within bolster receiver 46, and in turn allows a limited rocking motion of the side frames relative to bolster 10, while maintaining the orthogonal relationship between bolster 10 and side frames 40. Referring to FIG. 2, line "N" extends from pitch axis "P" along side frame 40 in what is referred to herein as the normal alignment. Side frame 40 may pitch up relative to bolster 10 to the level indicated by dash-double dot line "U", and may pitch down relative to bolster 10 to the level indicated by dash-dot line "D". The pitch of side frame 40 relative to bolster 10 is limited by the height of upper spacer 22 above the upper surface of sideframe keeper 16.

Although a preferred embodiment of the invention has been disclosed herein, it should be appreciated that further variation and modifications may be made thereto without departing from the scope of the invention as defined in the appended claims.

I claim:

1. A method of assembling a model railroad truck structure, comprising:

providing a truck bolster having inner and outer flanges and a pair of truck side frames having a bolster receiver with bolster radii therein;

placing truck springs on spring retainers, which receive the springs with a clearance fit, associated with an end of the truck bolster;

pushing an end of the truck bolster into the upper portion of the bolster receiver such that the end of the truck bolster travels along the bolster radii to position the bolster in the bolster receiver, including tilting the truck bolster down relative to the side frame to place the springs on a spring platform of the side frame, and then tilting the truck bolster upward to locate the inner and outer flanges of the bolster in the bolster receiver;

compressing the truck springs while simultaneously pushing the end of the truck bolster through the bolster receiver; and decompressing the truck springs to allow the bolster outer flange to abut the outer portion of the bolster radii and allowing the inner flange to abut the interior side of the side frame, thereby retaining the bolster in the side frame.

2. The method of claim 1 which further includes providing a bolster having at least one spring retainer located adjacent each end thereof.

* * * * *